US008850864B2

(12) United States Patent
Kubo

(10) Patent No.: US 8,850,864 B2
(45) Date of Patent: Oct. 7, 2014

(54) PRESS-PROCESSING METHOD, AND PRESS-PROCESSING APPARATUS

(75) Inventor: Masao Kubo, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 510 days.

(21) Appl. No.: 12/739,039

(22) PCT Filed: Nov. 10, 2008

(86) PCT No.: PCT/JP2008/070375
§ 371 (c)(1),
(2), (4) Date: Apr. 21, 2010

(87) PCT Pub. No.: WO2009/066572

PCT Pub. Date: May 28, 2009

(65) Prior Publication Data

US 2010/0236318 A1 Sep. 23, 2010

(30) Foreign Application Priority Data

Nov. 21, 2007 (JP) ..... 2007-301885

(51) Int. Cl.

| | |
|---|---|
| ***B21D 22/00*** | (2006.01) |
| ***B21D 24/02*** | (2006.01) |
| ***B21D 53/88*** | (2006.01) |
| ***B21D 24/04*** | (2006.01) |
| ***B21D 22/06*** | (2006.01) |
| ***B21D 22/26*** | (2006.01) |
| ***B21D 22/02*** | (2006.01) |

(52) U.S. Cl.

CPC ..... *B21D 22/02* (2013.01); *B21D 24/02* (2013.01); *B21D 53/88* (2013.01); *B21D 24/04* (2013.01); *B21D 22/06* (2013.01); *B21D 22/26* (2013.01)

USPC ..... 72/350; 72/348; 72/453.13

(58) Field of Classification Search

CPC ..... B21D 22/20; B21D 22/22; B21D 22/06; B21D 22/02; B21D 22/10

USPC ..... 72/347, 348, 350, 351, 453.13

See application file for complete search history.

(56) References Cited

U.S. PATENT DOCUMENTS 1,184,009 A * 5/1916 O'leary ..... 72/347
1,881,517 A * 10/1932 Groehn ..... 72/350

(Continued)

FOREIGN PATENT DOCUMENTS

JP 58 184024 10/1983
JP 59 163032 9/1984

(Continued)

OTHER PUBLICATIONS

English translations of Japanese patent 2903656, "Drawing Method", by Uchiyama Fujio, Kanehara Shiro, Kito Masatoshi, and Tanaka Naohiko, Uchiyama Fujio, Mar. 26, 1999.*

(Continued)

*Primary Examiner* — Shelley Self
*Assistant Examiner* — Chwen-Wei Su
(74) *Attorney, Agent, or Firm* — Oblon, Spivak, McClelland, Maier & Neustadt, L.L.P.

(57) ABSTRACT

This aims to provide a press process for drawing a plate material into a predetermined shape. This press process performs a first unwrinkling treatment and a second unwrinkling treatment sequentially for unwrinkling the material. Between these first and second unwrinkling treatments, an introduction for deforming the material is made so that the portion of the material on the side to be subjected to the second unwrinkling treatment may be positioned on the side of a drawing direction with respect to the portion subjected to the first unwrinkling treatment. This first unwrinkling treatment is made on such a portion to be unwrinkled in the material as is located on the side of a larger drawing depth for the predetermined shape. On the other hand, the second unwrinkling treatment is made on such a portion to be unwrinkled as is located on the side of a smaller drawing depth.

7 Claims, 10 Drawing Sheets

(56) References Cited

U.S. PATENT DOCUMENTS

| | | | | |
|---|---|---|---|---|
| 2,980,046 | A * | 4/1961 | McGregor et al. | 72/350 |
| 3,438,111 | A * | 4/1969 | Wilcox | 29/894.353 |
| 6,032,504 | A | 3/2000 | Onat et al. | |
| 6,415,640 | B1 * | 7/2002 | Haussermann | 72/350 |

FOREIGN PATENT DOCUMENTS

| | | |
|---|---|---|
| JP | 62 142033 | 6/1987 |
| JP | 2 55624 | 2/1990 |
| JP | 5 49124 | 6/1993 |
| JP | 2903656 | 3/1999 |
| JP | 2903656 | 6/1999 |

OTHER PUBLICATIONS

English translations of Japanese patent application, JP H05-49124U, "Pressing Tool for Draw Forming", by Okamura, Jun. 29, 1993.*

Extended Search Report issued Sep. 7, 2011 in Europe Application No. 08852659.5.

* cited by examiner

PRESS-PROCESSING METHOD, AND PRESS-PROCESSING APPARATUS

TECHNICAL FIELD

The present invention relates to a molding technique, especially to a press molding.

BACKGROUND ART

When manufacturing the panels of the vehicle body, a draw forming (or a drawing) is performed as the press molding. Popularly in the draw forming, a press molding apparatus is used, having a male mold called a punch, a female mold called a die arranged to face the male mold and a mold called a cushion for clamping a material in cooperated with the female mold. Using such apparatus, a sheet material such as a sheet metal (hereinafter called "blank") is formed into the desired shape. In draw forming, the periphery of the blank is clamped by clamping faces and the male and female molds approach each other, so that the blank is pressed and drawn in the molds. In the molding process, the approaching of the male and female molds causes the plastic deformation of the blank following the shape of molding surfaces, and the blank flows in the predetermined direction from the clamped portions.

The draw forming has problems such as a crack (break) in the blank. The cracks occurred in the molding are caused by the depth of drawing, the inflow of the blank in molding or the like. The conventional technique to prevent the cracks occurred in drawing is disclosed, for example, in JP S62-142033 A. JP S62-142033 A discloses the method that the angle of the clamping faces ("clamping angle") for clamping the blank is inclined by the predetermined angle to provide easy flow of the blank.

The technique disclosed in JP S62-142033 A (hereinafter called "conventional technique") makes the inflow of the blank smooth, and prevents the cracks in drawing. However, the conventional technique has problems as follows.

The molded articles molded by the draw forming include the panels of the vehicle body, which have complex curved shapes (hereinafter called "complex shaped articles"). In draw forming of the complex shaped articles, which have asymmetrical shapes, the forming amount of the blank differs locally (namely, the depth of drawing is not even).

Therefore, when employing the conventional technique for molding the complex shaped article, the larger clamping angle has to be set for the portion where the forming amount is comparatively large. In the case that the clamping angle becomes too large, there occurs a shortage of the clamping force. The shortage causes wrinkles in drawing.

Furthermore, in the molded article, the clamped portion may be used as a part of the product such as a flange. In draw forming such article, there is a restriction depending on the product shape, so that it is difficult to employ the conventional technique.

As mentioned above, in the case that the molded article has a simple shape and the blank flows from all around the clamped periphery, the conventional technique works well. On the other hand, in the case that the article has the complex shape or that the clamped periphery is used as a part of the product, the conventional technique does not work well.

DISCLOSURE OF INVENTION

Problems to be Solved by the Invention

The objective of the present invention is to provide an unexpected press molding method and a press molding apparatus enabled to prevent the cracks and wrinkles and to improve the stability of molding when the molded article has the complex shape, which brings the unevenness of the forming amount (depth of drawing) in the blank.

Means of Solving the Problems

The first aspect of the present invention is a press molding method of draw forming a plate material into a predetermined shape, clamping the material from both sides thereof using clamping faces facing, approaching and separating from each other, which includes a first clamping step and a second clamping step in order, and between the first clamping step and the second clamping step, the material is introduced to deform such that the portion clamped in the second clamping is positioned in the drawing direction side with respect to the portion clamped in the first clamping. Here, the first clamping step is a clamping of the material at a portion where a depth of drawing to the predetermined shape is comparatively deep in the clamped portion of the material. The second clamping step is a clamping of the material at a portion where the depth of drawing is comparatively shallow in the clamped portion of the material.

In the advantageous embodiment of the present invention, the introduction applied to the material is performed by means of the approach of the clamping faces used for the second clamping.

In the preferable embodiment of the present invention, the clamping faces used for the second clamping are inclined in accordance with a deformation angle of the material at the introduction.

The second aspect of the present invention is a press molding apparatus for draw forming a plate material into a predetermined shape, clamping the material from both sides thereof using clamping faces facing, approaching and separating from each other, which includes a first clamping part and a second clamping part. Here, the first clamping part clamps the material at a portion where a depth of drawing to the predetermined shape is comparatively deep in the clamped portion of the material. The second clamping part clamps the material at a portion where the depth of drawing is comparatively shallow in the clamped portion of the material. In the press molding apparatus, the first clamping part clamps the material, followed by clamping the material by the second clamping part, and the clamping faces of the second clamping part approach each other, whereby the material is introduced to deform such that the portion clamped in the second clamping is positioned in the drawing direction side with respect to the portion clamped in the first clamping.

In the advantageous embodiment of the present invention, the clamping faces of the second clamping part are inclined in accordance with a deformation angle of the material at the introduction.

The third aspect of the present invention is a press molding apparatus for draw forming a plate material into a predetermined shape, clamping the material from both sides thereof using clamping faces facing, approaching and separating from each other, which includes a fixed mold, a movable mold, first and second cushions. Here, the movable mold is arranged to face the fixed mold and movable in a direction approaching and separating from the fixed mold. The first and second cushions are arranged around the fixed mold, movable in the approaching and separating direction, and configured as molds for clamping the material in cooperated with the movable mold. Further, the movable mold includes, as the clamping faces, a first clamping face for clamping in cooperated with the first cushion and a second clamping face for clamping in cooperated with the second cushion arranged in the drawing direction side. In the press molding apparatus, the movable mold approaches the fixed mold, whereby a first clamping and a second clamping are performed in order, and between the first clamping and the second clamping, the material is introduced to deform such that the portion clamped in the second clamping is positioned in the drawing direction side with respect to the portion clamped in the first clamping. In the embodiment, the first clamping utilizes the movable mold and the first cushion. The second clamping utilizes the movable mold and the second cushion.

In the advantageous embodiment of the present invention, the second clamping face and the second cushion are inclined in accordance with a deformation angle of the material at the introduction.

Effect of the Invention

According to the present invention, it is possible to prevent the cracks and wrinkles and to improve the molding stability when the molded article has the complex shape, which brings the unevenness of the forming amount (depth of drawing) in the blank.

There is no need for preparing additional molds for introduction of the blank, thereby providing a simple structure. The introduction of the blank is finished in cooperated with the second clamping (clamping by the second clamping portion).

The second clamping avoids the wrinkles in the blank, thereby preventing the wrinkles from occurring in the second clamping.

BRIEF DESCRIPTION OF DRAWINGS

FIG. 3(*a*) depicts the first clamping (earlier clamping), FIG. 3(*b*) depicts the second clamping (later clamping).

FIG. 4(*a*) depicts the molding state in the drawing process, FIG. 4(*b*) depicts the finished state of the molding.

FIG. 5(*a*) shows the material in the first clamping (earlier clamping), FIG. 5(*b*) shows the material in the second clamping (later clamping).

THE BEST MODE FOR CARRYING OUT THE INVENTION

Figure 1:
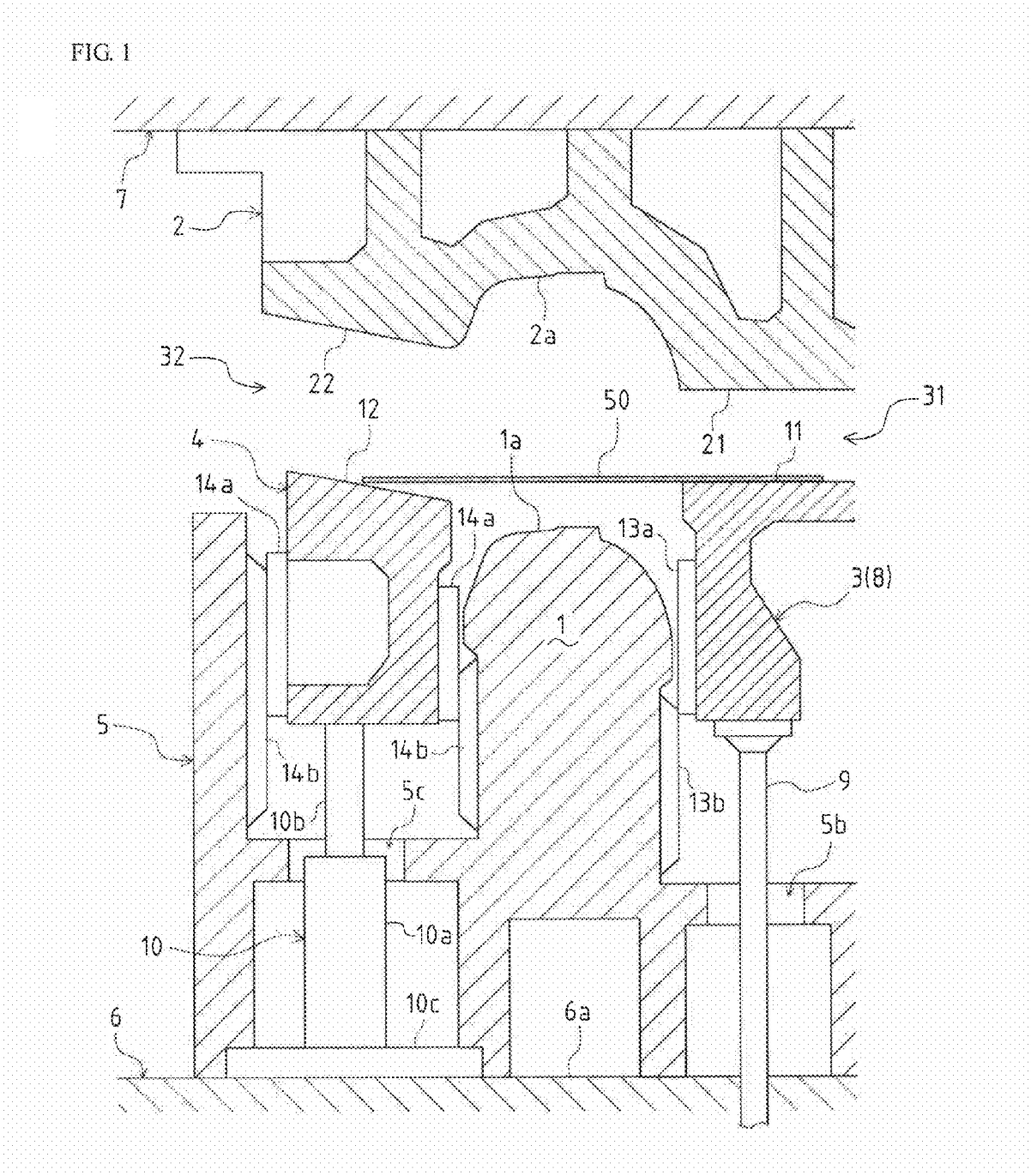
FIG. 1 is a section view illustrating a press molding apparatus according to the present invention.

The present invention relates to a press molding in which a sheet material (blank) is draw formed into the predetermined shape complexly curved, and when clamping the blank before the drawing acted on the blank by means of a punch, the blank is clamped in two steps at different timing and in different area in accordance with the difference of the forming amount (depth of drawing) of the blank caused by its asymmetrical shape or the like. The earlier clamping is carried out, and after that the later clamping is carried out following the deformation.

In detail, in the later clamping, the blank, which is in plate shape at the time of the earlier clamping, is deformed from the clamped portion in the later clamping toward the drawing direction with respect to the clamped portion in the earlier clamping. The deformation of the blank includes a bending (plastic deformation) and an elastic deformation. Thus, at the time that the two-step clamping is finished, the part of the blank apart from the portion clamped in the first clamping is introduced toward the drawing direction.

As shown in FIG. 1, the press molding apparatus in the embodiment includes two cushions (an outer cushion 3 and an inner cushion 4) having a different cushion stroke each other for clamping a blank 50 in cooperated with an upper mold 2 facing a punch 1.

The upper mold 2 approaches the punch 1, and the outer cushion 3 having the longer stroke clamps one side (right side in FIG. 1) of the periphery of the sheet blank 50, that is the earlier clamping. The upper mold 2 and the outer cushion 3 clamping the blank 50 move downward, and the inner cushion 4 having the shorter stroke clamps the other side (left side in FIG. 1) of the periphery of the blank 50, that is the later clamping.

In the later clamping by the inner cushion 4, from the earlier clamping by the outer cushion 3 to the later clamping for the blank 50 by the inner cushion 4, due to the approach of the inner cushion 4 to the upper mold 2, the sheet blank 50 is deformed toward the drawing direction (upward in FIG. 1) by the punch 1 from the clamped portion by the outer cushion 3.

Thus, when finishing the clamping for the blank 50 by the cushions 3, 4, the portion of the blank 50 apart from the portion clamped by the outer cushion 3 is introduced toward the drawing direction. The upper mold 2 moves downward together with the cushions 3, 4 to the bottom dead end, and the blank 50 is draw formed into the predetermined shape.

The embodiments of the press molding method and the press molding apparatus are described below.

The structure of the press molding apparatus of the embodiment will be explained referring FIGS. 1, 2. FIG. 1 is the A-A line sectional view of FIG. 2.

In the embodiment, as a product manufactured from a molded article molded by using the press molding apparatus, a wheel house outer is adopted which is used as a panel of the vehicle body. The wheel house outer forms a wheel house, which defines the space for the rotating wheel attached to the body.

Figure 2:
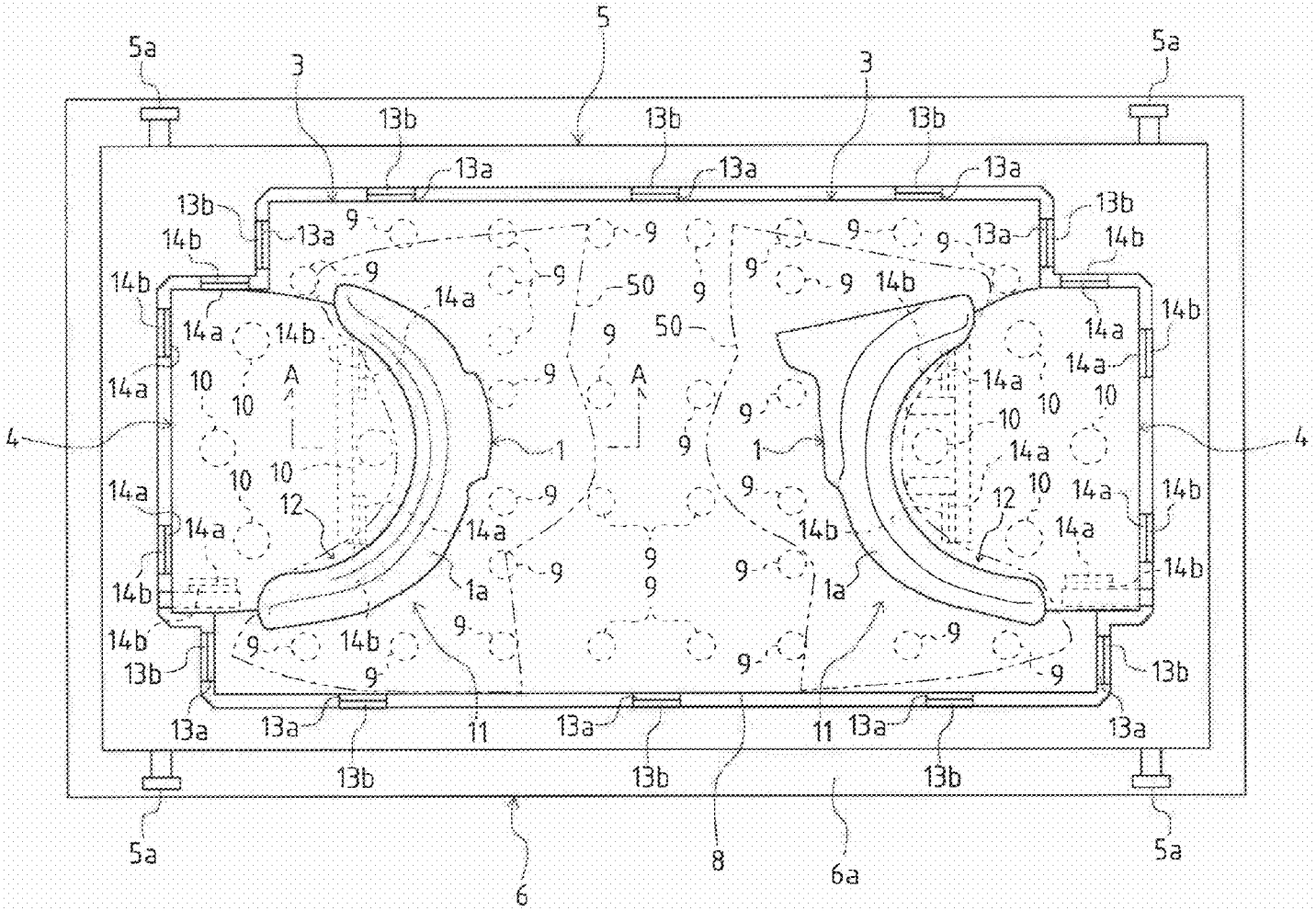
FIG. 2 is a plan view illustrating the press molding apparatus apart from the upper mold (namely, illustrating the die face).

The press molding apparatus according to the embodiment (hereinafter called "the present apparatus") molds, as shown in FIG. 2, a left-and-right pair of the wheel house outers of the body by one time pressing.

In the following explanation, the vertical direction in FIG. 1 is defined as the vertical direction of the present apparatus.

As shown in FIGS. 1, 2, the present apparatus performs the draw forming on the blank 50 to form the predetermined shape including the product part of the wheel house outer. The present apparatus, in draw forming, performs a clamping in which the part of the blank 50 is clamped from the both sides by means of the clamping faces which are facing each other and telescopically move (briefly called "clamping").

The present apparatus includes the punch 1 as a fixed mold and the upper mold 2 as a movable mold.

The punch 1 is formed as a part of a lower mold 5 of the present apparatus. The lower mold 5 is positioned and fixed to a bolster 6 of the present apparatus. The bolster 6 has a support surface 6*a* as a level surface. The lower mold 5 has a hook 5*a* for carry.

The punch 1 is arranged in the lower mold 5 and has a shape of a male mold for pressing the blank 50 from the bottom thereof. The punch 1 has a molding surface 1*a* formed at the end as a male surface (hereinafter called "lower molding surface"). The punch 1 is included in the lower mold 5 for draw forming the blank 50 into the predetermined shape including the product part of the wheel house outer. The wheel house outer has an arc portion formed by the punch 1. In the embodiment, the punch 1 is formed, as shown in FIG. 2, in the protrusion having the arc portion in plan view.

The upper mold 2 is arranged and fixed to a slide plate 7 of the present apparatus. The slide plate 7 moves in the approaching and separating direction (upward and downward in the vertical direction) with respect to the bolster 6 by means of an actuator not shown. In other words, the upper mold 2 is disposed at the slide plate 7, thereby moving in the approaching and separating direction (upward and downward in the vertical direction) with respect to the punch 1 (the upper mold 5) fixed to the bolster 6. Note that in the following description, the approaching and separating direction of the upper mold 2 with respect to the punch 1 is referred to the "vertical direction."

The upper mold 2 has a molding surface 2*a* formed as a female surface corresponding to the punch 1 (hereinafter called "upper molding surface"). The upper molding surface 2*a* has a shape following the lower molding surface 1*a*. The upper mold 2 is formed as the female mold for receiving the blank 50 at the top of the blank 50 pressed from the bottom side by the punch 1.

The present apparatus has the first and second cushions which move in the vertical direction disposed around the punch 1 and clamp the blank with the upper mold 2.

The present apparatus has, as the cushions disposed around the punch 1 in the side of the lower mold 5, the outer cushion 3 (the first cushion) arranged in the outside of the arc portion of the punch 1 in plan view and the inner cushion 4 (the second cushion) arranged in the inside.

The present apparatus molds the pair of the wheel house outers at a time as described above, so that the outer cushions 3 used for molding the pair of the wheel house outers are configured as an integral (common) mold 8.

Each of the punches 1 used for molding the pair of the wheel house outers has an arc shape, and these punches 1 are arranged in the common lower mold 5, in which the outsides of the arc face each other. As shown in FIG. 2, the punches 1 formed in the arc shapes in plan view are arranged in the lower mold 5 such that the outsides of the arc shapes are facing each other and are substantially symmetry (bilateral symmetry as depicted in FIG. 2). Therefore, the outer cushions 3 each of which arranged outside of the arc shape of the punch 1 are positioned between the punches 1. So, the mold including the outer cushions 3 provided with respect to the punches 1 is integrally (commonly) configured as the mold 8.

The inner cushions 4 provided with respect to the punches 1 are, as shown in FIG. 2, disposed at the outsides of the present apparatus (left and right outsides in FIG. 2) and they are configured as separated (independent) molds.

The outer cushion 3 has a clamping face 11 formed at the top facing the upper mold 2 (hereinafter called "first lower clamping face"). The first lower clamping face 11 is a level face in the embodiment (see FIG. 1). The outer cushion 3 clamps the periphery of the blank 50 in cooperated with the upper mold 2 by means of the first lower clamping face 11. The upper mold 2 has a clamping face 21 for clamping the blank 50 in cooperated with the first lower clamping face 11 (hereinafter called "first upper clamping face"). The first upper clamping face 21 is a level face continued from the edge of the upper molding surface 2*a* of the upper mold 2. Thus, in the blank 50, the portion clamped by the outer cushion 3 and the upper mold 2 becomes the portion clamped by the first lower clamping face 11 and the first upper clamping face 21.

The outer cushion 3 moves in the vertical direction with engaging with the lower mold 5 including the punch 1. The outer cushion 3 is moved by a cushion pin 9. The cushion pin 9 has a stick structure supporting the outer cushion 3 from the lower side (that is the opposite side to the first lower clamping face 11).

The cushion pin 9 moves in the vertical direction projecting upward from the support surface 6*a* of the bolster 6. The cushion pin 9 is supported by a damper (not shown) such as a hydraulic cylinder arranged below the support surface 6*a*.

The cushion pin 9 applies the cushion load to the outer cushion 3 in cooperated with the down move of the upper mold 2 with clamping the blank 50 together with the upper mold 2. In other words, the cushion load of the cushion pin 9 acts on the outer cushion 3 movably supported by the cushion pin 9 from the position where the blank 50 is clamped by the outer cushion and the upper mold 2 in cooperated with the down of the upper mold 2 to the bottom dead end where the molding is finished.

The multiple cushion pins 9 are arranged in the predetermined intervals (density) with respect to the mold 8 configuring the outer cushions 3 (see FIG. 2).

In the embodiment, the lower mold 5 mounted on the support surface 6*a* has holes 5*b* for accepting the vertical movement of the cushion pins 9 and the projections of them from the support face 6*a*.

The outer cushion 3 slides along the lower mold 5 including the punch 1. In detail, the outer cushion 3 has slide plates 13*a* at the border against (wall facing) the lower mold 5. The lower mold 5 has sliders 13*b* respectively engaging the slide plates 13*a* of the outer cushion 3 at the border against (wall facing) the outer cushion 3. The slider 13*b* of the lower mold 5 corresponds to the slide plate 13*a* of the outer cushion 3. Thus, the outer cushion 3 slides along the lower mold 5 by means of the slide plates 13*a* and sliders 13*b*.

As shown in FIG. 2, there are the multiple engaging portions of the slide plates 13*a* and the sliders 13*b* spaced in the predetermined intervals in the border between the outer cushion 3 and the lower mold 5.

The inner cushion 4 has a clamping face 12 formed at the top facing the upper mold 2 (hereinafter called "second lower clamping face"). The second lower clamping face 12 is an inclined face in the embodiment (see FIG. 1). The inner cushion 4 clamps the periphery of the blank 50 in cooperated with the upper mold 2 by means of the second lower clamping face 12. The upper mold 2 has a clamping face 22 for clamping the blank 50 in cooperated with the second lower clamping face 12 (hereinafter called "second upper clamping face"). The second upper clamping face 22 is continued from the edge of the upper molding surface 2*a* of the upper mold 2. Thus, in the blank 50, the portion clamped by the inner cushion 4 and the upper mold 2 becomes the portion clamped by the second lower clamping face 12 and the second upper clamping face 22.

The second upper clamping face 22 of the upper mold 2 is disposed in the drawing direction side with respect to the first upper clamping face 21 of the upper mold 2. When the upper mold 2 clamps with the inner cushion 4, the second clamping faces 22, 12 clamp the blank 50 at the position located in the drawing direction side with respect to the clamping position of the blank 50 by the first clamping faces 21, 11 using the outer cushion 3.

Here, in the present apparatus, the drawing direction side means the upper side (in FIG. 1). That is, the "drawing direction side" means the pressing direction for the blank 50 by the punch 1, i.e. the approaching direction of the punch 1 to the upper mold 2 in draw forming the blank 50.

As described above, the upper mold 2 has the first upper clamping face 21 as the first clamping face for clamping in cooperated with the outer cushion 3 and the second upper clamping face 22 as the second clamping face disposed in the drawing direction side and for clamping in cooperated with the inner cushion 4.

The inner cushion 4 moves in the vertical direction with engaging with the lower mold 5 including the punch 1 as the same as the outer cushion 3. The inner cushion 4 is moved by a cushion cylinder 10. The cushion cylinder 10 has a cylinder structure supporting the inner cushion 4 from the lower side (that is the opposite side to the second lower clamping face 12).

The cushion cylinder 10 has a cylinder portion 10*a* and a rod portion 10*b* projecting form one end thereof and sliding in the cylinder portion 10*a*. The cushion cylinder 10 telescopically moves according to the slide of the rod portion 10*b* against the cylinder portion 10*a*. The cushion cylinder 10 supports the inner cushion 4 at one end of the rod portion 10*b*. The cushion cylinder 10 is mounted on the support surface 6*a* of the bolster 6, in which the cylinder portion 10*a* is disposed at the lower side. The cushion cylinder 10 is mounted on the support surface 6*a* via a base portion 10*c*. As the cushion cylinder 10, employed is a nitrogen gas cylinder enclosed with the nitrogen gas in the cylinder portion 10*a* or a hydraulic cylinder.

The cushion cylinder 10 applies the cushion load to the inner cushion 4 in cooperated with the down move of the upper mold 2 with clamping the blank 50 together with the upper mold 2. In other words, the cushion load of the cushion cylinder 10 acts on the inner cushion 4 movably supported by the cushion cylinder 10 from the position where the blank 50 is clamped by the inner cushion and the upper mold 2 in cooperated with the down of the upper mold 2 to the bottom dead end where the molding is finished.

The multiple cushion cylinders 10 are arranged in the predetermined intervals (density) with respect to the inner cushion 4 (see FIG. 2).

In the embodiment, the lower mold 5 mounted on the support surface 6*a* has holes 5*c* for accepting the vertical movement of the cushion cylinders 10 and the mounting thereof on the support surface 6*a*.

The inner cushion 4 slides along the lower mold 5 including the punch 1 as the same as the outer cushion 3. In detail, the inner cushion 4 has slide plates 14*a* at the border against (wall facing) the lower mold 5. The lower mold 5 has sliders 14*b* engaging the slide plates 14*a* of the inner cushion 4 at the border against (wall facing) the inner cushion 4. Thus, the inner cushion 4 slides along the lower mold 5 by means of the slide plates 14*a* and the sliders 14*b*.

There are the multiple engaging portions of the slide plates 14*a* and the sliders 14*b* spaced in the predetermined intervals in the border between the inner cushion 4 and the lower mold 5 (see FIG. 2).

The outer cushion 3 has a different stroke from that of the inner cushion 4.

The upper mold 2 has the second upper clamping face 22 corresponding to the inner cushion 4 that is disposed in the drawing direction side with respect to the first upper clamping face 21 corresponding to the outer cushion 3. When performing the press molding using the present apparatus, the blank 50 is set horizontally to the clamping faces of the cushions 3, 4 that is the first and second lower clamping faces 11, 12. One end (right end in FIG. 1) of the blank 50 is supported by the first lower clamping face 11 and the other end (left end in FIG. 1) of the blank 50 is supported by the second lower clamping face 12. Therefore, the cushions 3, 4 supporting the blank 50 wait the down of the upper mold 2 in the clamping faces being the same height so as to keep the blank 50 horizontal.

The blank 50, set horizontally to the cushions 3, 4, is clamped by the first clamping faces 11, 21 according to the down move of the upper mold 2, and the blank is clamped by the outer cushion 3 and the upper mold 2. Next, the blank 50, clamped by the outer cushion 3 and the upper mold 2, is clamped by the second clamping faces 12, 22, and the blank is clamped by the inner cushion 4 and the upper mold 2. Finally, the upper mold 2, the outer cushion 3 and the inner cushion 4 reach the bottom dead end where the molding is finished, with the blank 50 clamped by the upper mold 2 and cushions 3, 4.

As explained above, the cushions 3, 4 have the cushion strokes each of which is set as the down range from the position where clamping the blank 50 with the upper mold 2 to the bottom dead end. In other words, each of the cushions 3, 4 has the cushion stroke in which the cushion load is applied to the blank 50.

Therefore, the outer cushion 3 has the longer stroke which clamps with the upper mold 2 in advance than that of the inner cushion 4 which clamps subsequently with the upper mold 2.

In the present apparatus including the structure explained above, when clamping the blank 50, the approach of the upper mold 2 to the punch 1 brings the first clamping as the clamping by the upper mold 2 and the outer cushion 3, and the second clamping as the clamping by the upper mold 2 and the inner cushion 4 in order. In the present apparatus, the blank 50 is introduced to deform toward the drawing direction between the first clamping and the second clamping.

The press molding of the embodiment will be explained, adding the references of FIGS. 3 to 5.

In the press molding, the present apparatus, for example shown in FIG. 1, keeps the upper mold 2 and cushions 3, 4 waiting at the predetermined height (hereinafter called "waiting state" of the present apparatus). In the waiting state, the upper mold 2 is in the position separated from the punch 1 to form a mold-opened state of the punch 1 and the upper mold 2. In the waiting state, the cushions 3, 4 are also in the position where the clamping faces (first and second lower clamping faces 11, 12) are above the top of the lower molding surface 1*a*.

In the waiting state of the present apparatus depicted in FIG. 1, the blank 50 to be molded is set. The blank 50 is set horizontally mounting on the first and second lower clamping faces 11, 12 by the cushions 3, 4. The blank 50, which is set on the cushions 3, 4 in the waiting state, is separated from the punch 1 at the bottom surface. The blank 50 is set horizontally above the punch 1.

The blank 50 set as mentioned above has, as depicted by the two-dotted line in FIG. 2, the complex plate shape.

From the waiting state shown in FIG. 1, a clamping step for the blank 50 is started.

When clamping the blank 50, the first clamping is performed after the waiting state.

Figure 3:
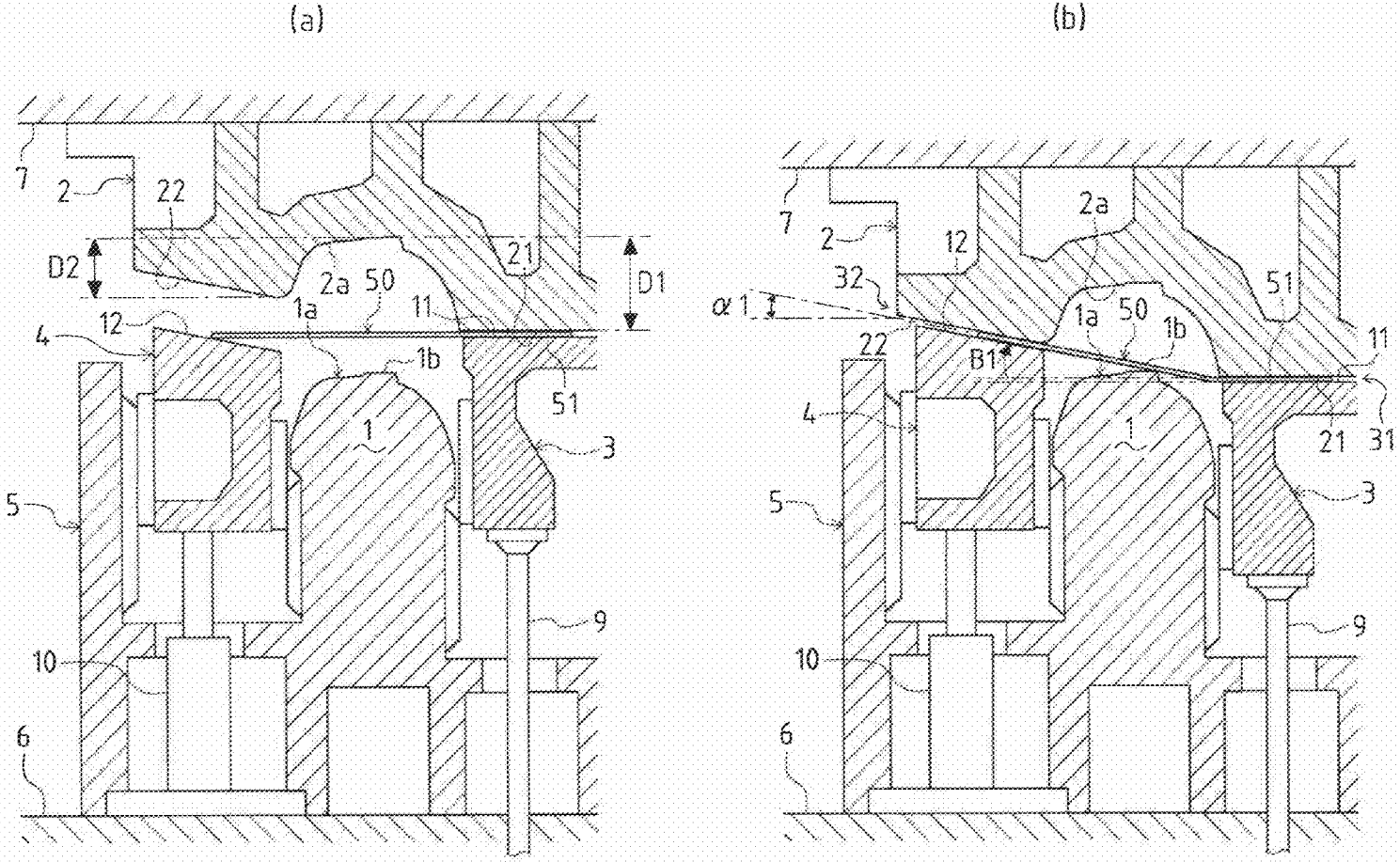
FIG. 3 is a section view illustrating the clamping process in the press molding of the present embodiment.

In detail, as shown in FIG. 3(*a*), according to the down of the upper mold 2, that is the approach of the upper mold 2 to the punch 1, the first upper clamping face 21 positioning below the second upper clamping face 22 reaches the blank 50.

The blank 50 set horizontally along the first lower clamping face 11 is clamped by the first clamping faces 11, 21 in response to the down of the upper mold 2. Then, the first clamping is finished. Hereinafter, the state where the first clamping for the blank 50 is performed is called "first holding state."

Figure 5:
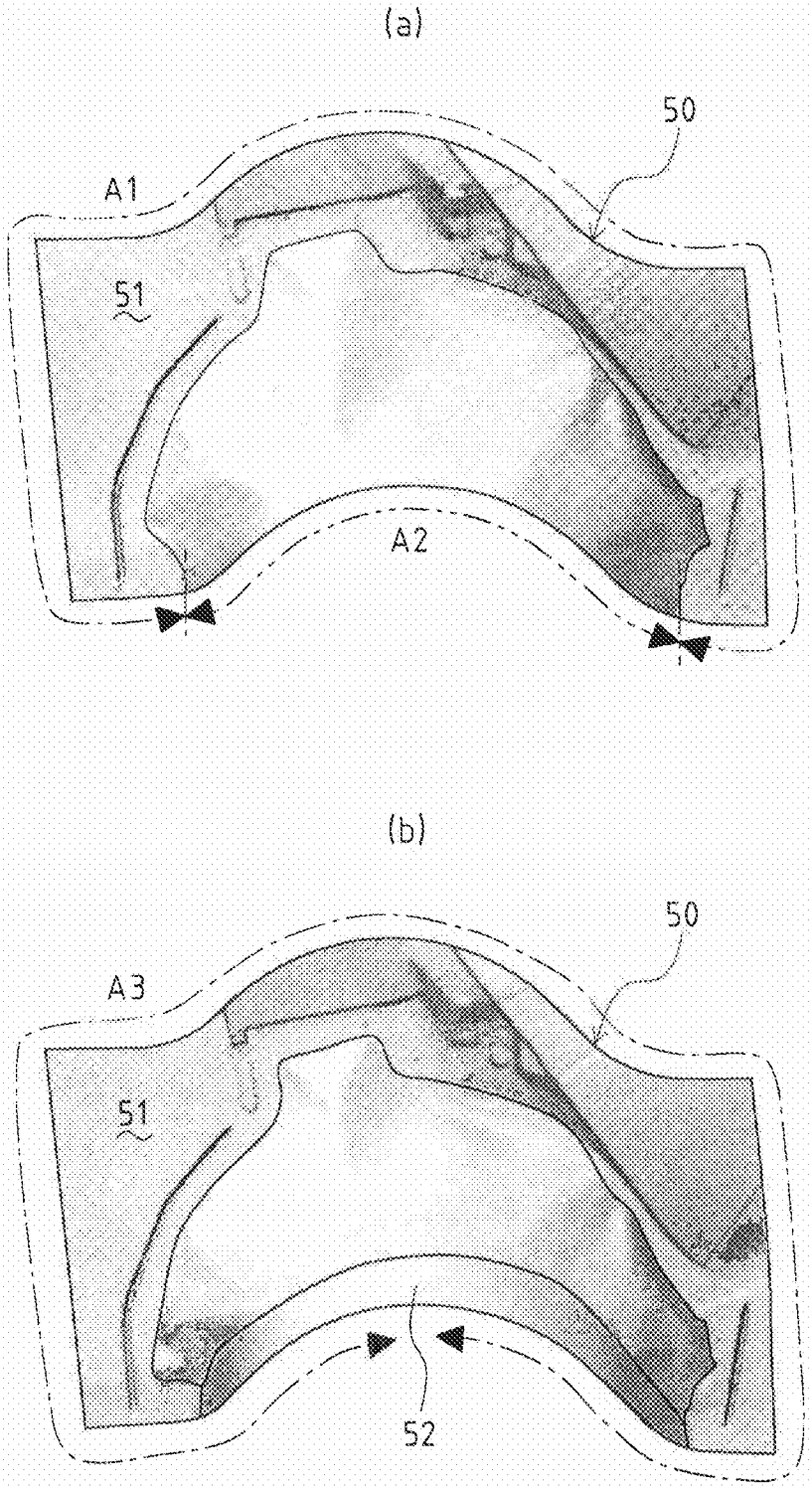
FIG. 5 is a picture showing the simulation result as to the clamped material.

As shown in FIG. 5(*a*), in the first holding state, the blank 50 is clamped in the area (see the arrowed area A1 illustrated by dotted line) of the periphery, which is the outside of the arc portion of the punch 1. In the first holding state for the blank 50, the portion where the first clamping is carried out becomes a clamped portion 51 clamped by the first clamping faces 11, 21.

As shown in FIG. 5(*a*), in the first holding state, the blank 50 is not clamped in the area (see the arrowed area A2 illustrated by two-dotted line) of the periphery, which is the inside of the arc portion of the punch 1. In the first holding state for the blank 50, the periphery except in the clamped portion 51 will be clamped in the second clamping by the second clamping faces 12, 22 later.

Keeping the first holding state, the second clamping is carried out.

As shown in FIG. 3(*b*), in response to the down of the upper mold 2, that is the approach to the punch 1 of the upper mold 2 clamping the blank 50 with the outer cushion 3, the second upper clamping face 22 positioning above the first upper clamping face 21 reaches the blank 50 in the first holding state.

Here, due to the down of the clamped portion 51 in response to the down move of the upper mold 2 and the outer cushion 3 with the part of the blank supported by the second lower clamping face 22, the blank 50 keeping horizontal (level) in the first holding state is deformed such that the supported side by the second lower clamping face 12 is positioned in the drawing direction side. The inner cushion 4 prevents the down beyond the clamped portion 51 of the blank 50 clamped by the upper mold 2 and the outer cushion 3, so that the deformation occurs toward the drawing direction side from the clamped portion 51 in the side of the blank supported by the second lower clamping face 12 of the inner cushion 4.

As described above, the deforming step of the blank 50, which keeps horizontal in the first holding state, corresponds to the introduction of the present apparatus. The deformation applied to the blank 50 in the introduction includes bending (plastic deformation) and elastic deformation.

The blank 50 deformed by the introduction is clamped by the second clamping faces 12, 22 in response to the down of the upper mold 2. Then, the second clamping is finished, so that the clamping for blank 50 is finished. Hereinafter, the state where the blank 50 is wholly clamped is called "held state."

In the held state, the blank 50 is clamped in the area (see the arrowed area A2 illustrated by two-dotted line) of the periphery, which is the inside of the arc portion of the punch 1. As shown in FIG. 5(*b*), in the held state for the blank 50, the portion where the second clamping is carried out becomes a clamped portion 52 clamped by the second clamping faces 12, 22.

Therefore, as shown in FIG. 5(*b*), in the held state, the periphery of the blank 50 is wholly clamped (see the arrowed area A3 illustrated by dotted line).

Thus, the present apparatus deforms the blank 50 as the introduction between the first clamping and the second clamping in such a way that the portion of the blank 50 clamped in the second clamping is positioned in the drawing direction side with respect to the clamped portion 51 of the blank 50 clamped in the first clamping. In other words, the introduction of the present apparatus is to deform the blank 50 such that the portion clamped in the second clamping is positioned in the drawing direction side with respect to the clamped portion 51.

The blank 50, which is horizontal in the first holding state shown in FIG. 3(*a*), is deformed by the introduction carried out between the first holding state and the held state shown in FIG. 3(*b*). Thus, the part of the blank 50 (left side over the clamped portion 51 in FIG. 3) is introduced toward the drawing direction with respect to the clamped portion 51 (see the arrow B1).

After the clamping step, the drawing step is carried out.

Figure 4:
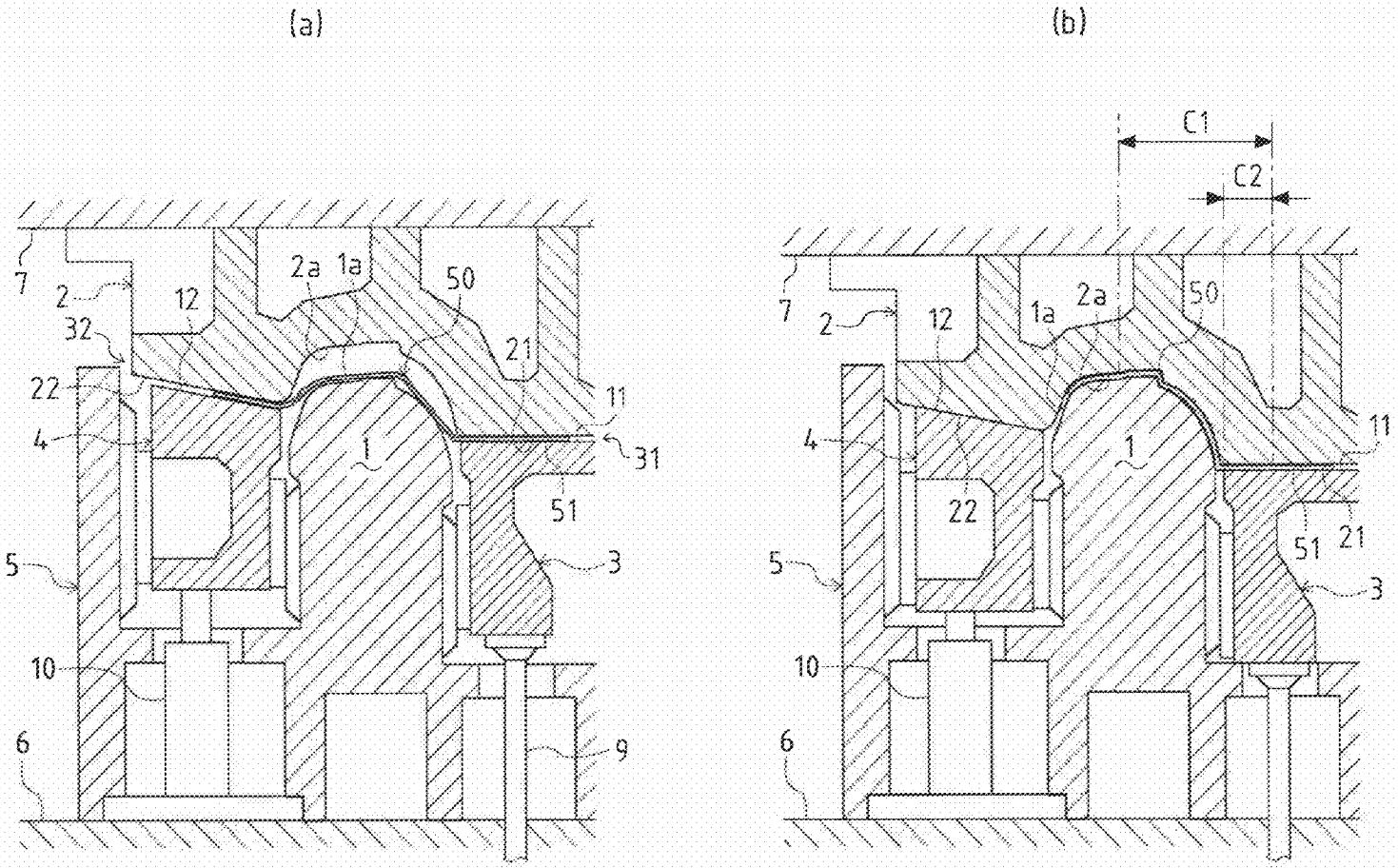
FIG. 4 is a section view illustrating the drawing process in the press molding of the present embodiment.

As shown in FIG. 4(*a*), the upper mold 2 keeps clamping the blank 50 with the cushions 3, 4 and moves down together with the cushions 3, 4, so that the punch 1 presses the blank 50. In accordance with the down move of the blank 50 in the held state, the blank 50 is pressed by the punch 1, thereby draw forming along the lower molding surface 1*a*.

In the embodiment, in draw forming the blank 50, the portion of the blank 50 where the second clamping is carried out, that is the portion clamped by the second clamping faces 12, 22, flows into the side of the punch 1. In the embodiment, the flow of the blank 50 in the draw forming does not occur from the portion where the first clamping is carried out, that is the clamped portion 51 clamped by the first clamping faces 11, 21, but from the portion where the second clamping is carried out.

As a result, in the present apparatus, each of the cushion loads of the cushion pin 9 and the cushion cylinder 10 is set in such a way that the clamping loads applied to the blank 50 from the cushions 3, 4 satisfy the condition where the blank 50 flows only from the portion clamped in the second clamping and does not flow from the clamped portion 51 clamped in the first clamping.

The cushion load of the cushion pin 9 is set such that the clamping load applied to the blank 50 from the outer cushion 3 prevents the flow of the material toward the punch 1 in the draw forming for the blank 50.

The cushion load of the cushion cylinder 10 is set such that the clamping load applied to the blank 50 from the inner cushion 4 allows the material flow toward the side of the punch 1 in the draw forming performed on the blank 50 and that the wrinkles caused by the deformation accompanied by the introduction applied to the blank 50 are prevented.

In the draw forming step for the blank 50, the upper mold 2 moves down and reaches, as shown in FIG. 4(*b*), the bottom dead end with the cushions 3, 4, and the draw forming step is finished, thereby finishing the press molding for the blank 50. The blank 50 is clamped by the molding surfaces 1*a*, 2*a*, thereby formed in the predetermined shape including the clamped portion 51 and the product shape of the wheel house outer.

In the present apparatus, in the formed state of the blank 50 shown in FIG. 4(*b*), the portion clamped by the second clamping faces 12, 22 flows completely toward the punch 1 (which is not clamped).

After the press molding for the blank 50 is finished, the punch 1 and the upper mold 2 are opened and the blank 50 as the molded article in the predetermined shape is removed therefrom.

As to the molded article produced by the present apparatus, the useless portion is cut off, that is the portion apart from the product part of the wheel house outer.

In detail, as to the molded article produced by the present apparatus, the arrowed area C1 in FIG. 4(*b*) is used for the product part of the wheel house outer. In the molded article (blank 50) of the present apparatus, the periphery of the portion clamped by the upper mold 2 and the outer cushion 3 (the clamped portion 51) and the periphery of the portion (left side end portion in FIG. 4) clamped by the molding surfaces 1*a*, 2*a* are cut off by the predetermined areas. Thus, the product part of the wheel house outer is obtained from the molded article.

As a result, as to the molded article of the present apparatus, the part (see the arrowed area C2 in FIG. 4(*b*)) of the portion clamped by the upper mold 2 and the outer cushion 3 (clamped portion 51) is used for the product. In this case, that part is used for the flange of the wheel house outer.

As described above, in the press molding for the wheel house outer, the clamped portion is used for the product part in the blank 50, and the press molding method enabled to prevent the clamped portion from flowing out in draw forming is adopted. The press molding method is based on the aspect of the product quality in press molding the wheel house outer.

In the molded article of the present apparatus, the depth of drawing as the forming amount of the blank 50 to the predetermined shape is not uniform and partially different.

Specifically, in the embodiment of the blank 50, the depth of drawing of the portion firstly clamped (right side in FIG. 4) is deeper compared with that of the portion secondly clamped (left side in FIG. 4). As shown in FIG. 3(*a*), in the present apparatus, the depth of drawing D1 of the firstly clamped portion is deeper than the depth of drawing D2 of the secondly clamped portion.

Therefore, in the embodiment, the firstly clamped portion of the blank 50, that is the outside of the arc portion of the punch 1, is the deeper side regarding the depth of drawing for the molded article through the predetermined shape. The secondly clamped portion of the blank 50, that is the inside of the arc portion of the punch 1, is the shallower side regarding the depth.

In the press molding method of the embodiment, as the clamping of the plate blank 50, the first clamping that is the clamp of the deeper portion in the clamped portion of the blank 50 and the second clamping that is the clamp of the shallower portion are performed in order.

Between the first clamping and the second clamping, the introduction for deforming the blank 50 is performed such that the portion clamped in the second clamping for the blank 50 is positioned in the drawing direction side with respect to the clamped portion 51 that is the portion clamped in the first clamping. Due to the introduction, the blank 50 is deformed such that the portion clamped in the second clamping is positioned in the drawing direction side with respect to the clamped portion 51 of the blank 50.

The introduction performed in the clamp for the blank 50 is preferably performed in cooperated with the approach of the clamping face to clamp in the second clamping.

It means that the introduction applied to the blank 50, as the present apparatus, is preferably performed by the approach of the second clamping faces 12, 22. The approach of the clamping faces in the present apparatus is that of the second clamping faces 12, 22 cooperated with the down move of the upper mold 2 clamping the blank 50 with the outer cushion 3.

Provided in the present apparatus, the introduction applied to the blank 50 is performed by the approach of the clamping faces in the second clamping, so that no additional molds are used for the introduction of the blank 50, thereby simplifying the structure of the press mold. Moreover, the introduction of the blank 50 is smoothly performed in cooperated with the second clamping.

As explained, the present apparatus includes, as the clamping part for the blank 50, an outer clamping part 31 for clamping the portion of the blank 50 where the depth of drawing to the predetermined shape is comparatively deep in the clamped portion of the blank 50 and an inner clamping part 32 for claming the portion of the blank where the depth of drawing is comparatively shallow in the clamped portion.

In other words, the present apparatus has the outer clamping part 31, configured in the upper mold 2 and the outer cushion 3 as the pair of first clamping faces 11, 21, which approach and separate from each other. The present apparatus has the inner clamping part 32, configured in the upper mold 2 and the inner cushion 4 as the pair of second clamping faces 12, 22.

When the clamping by means of the inner clamping part 32, the present apparatus deforms the blank 50 in cooperated with the approach of the clamping faces (second clamping faces 12, 22) in such a way that the portion of the blank 50 clamped by the inner clamping part 32 is positioned in the drawing direction side with respect to the clamped portion 51. The present apparatus uses the approach of the inner clamping part 32 to deform the blank 50 such that the portion of the blank 50 clamped by the inner clamping part 32 is positioned in the drawing direction side with respect to the clamped portion 51.

In the present apparatus, the clamping faces of the inner clamping part 32, that is the second clamping faces 12, 22 are configured as the inclined face according to the deformation angle of the blank 50 in the introduction.

The second clamping faces 12, 22 are inclined toward the punch 1 as described above. These inclining angle of the clamping faces are (the substantially same as) the angle corresponding to the deformation angle of the blank 50 in the introduction (hereinafter called "blank deformation angle"). Here, the blank deformation angle includes the inclining angle caused by bending (plastic deformation) and by elastic deformation. Hereinafter, for the convenience, the blank deformation angle is the inclining angle caused by bending (bending angle) of the blank 50.

The inclining angles of the second clamping faces 12, 22 with respect to the perpendicular face (level face) to the moving direction (vertical direction) of the upper mold 2 are set to correspond to (become substantially the same as) the blank deformation angle, that is the bending angle (see the angle $\alpha$1 in FIG. 3(*b*)) of the blank 50 completely clamped in the second clamping with respect to the level face bent from the clamped portion 51.

The blank deformation angle is defined by the difference of the heights between the inside edge (edge of the side of the punch 1) of the outer clamping part 31 and that of the inner clamping part 32 in the held state. In other words, the blank deformation angle is defined by the difference of the heights between the inside edges (edges of the side of the punch 1) of the first upper clamping face 21 and of the second upper clamping face 22.

Therefore, in the present apparatus, the clamping faces of the inner clamping part 32 are inclined in correspondence with the blank deformation angle, so that the portion of the blank 50 clamped by the second clamping faces 12, 22 in the held state is along with the blank deformation angle, and is positioned in the extending line of the bent portion from the clamped portion 51. In other words, in the held state, the blank 50 has no bent portion between the bent portion with respect to the clamped portion 51 and the clamped portion by the second clamping faces 12, 22.

The inclining angle regarding the clamping faces of the inner clamping part 32, which is the blank deformation angle, is not limited, and that may be set around 15 degrees.

Thus, the clamping faces for performing the second clamping (the second lower clamping face 12 and the second upper clamping face 22) are inclined in response to the blank deformation angle, so that the second clamping (the clamping for the blank 50 by the second lower clamping face 12 and the second upper clamping face 22) does not occur the bending in the blank 50, thereby preventing the wrinkles of the blank 50 from occurring in the second clamping. As a result, the wrinkles occurred in the blank 50 in the held state are effectively restricted.

Figure 6:
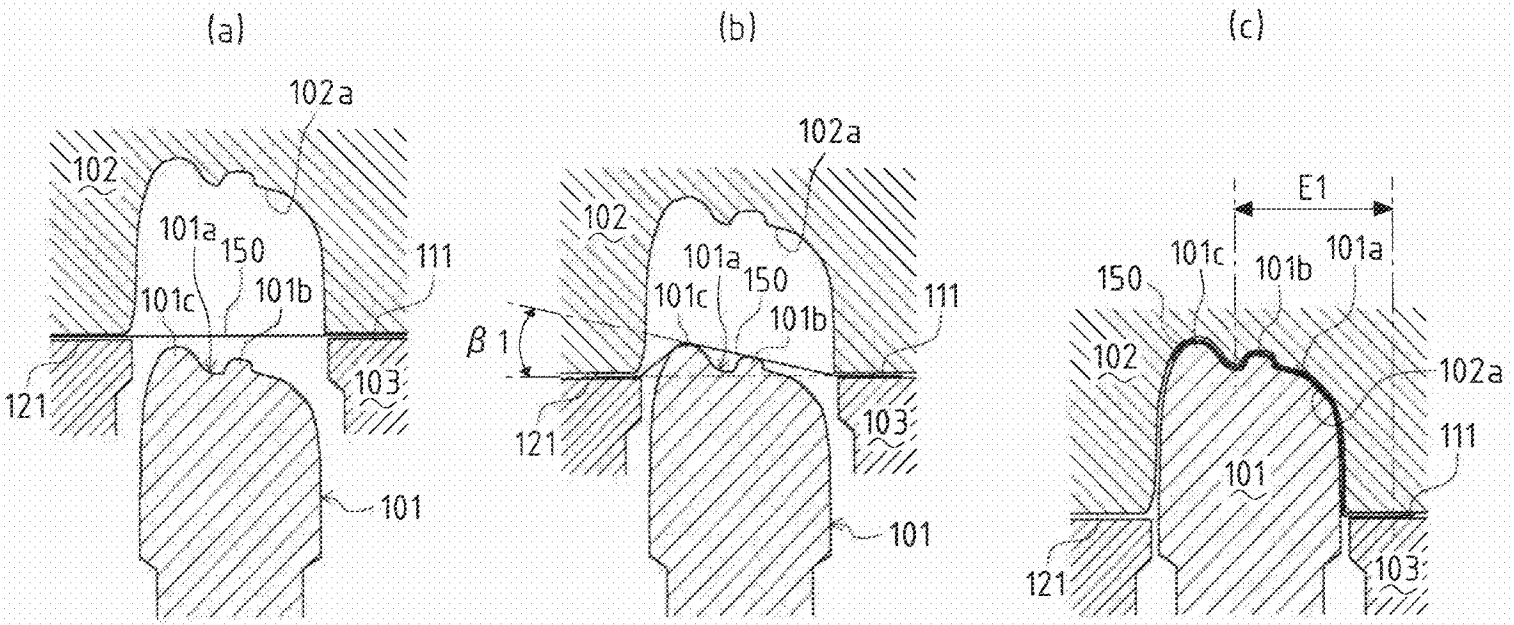
FIG. 6 is an enlarged section view illustrating the press molding process using the first conventional embodiment.
Figure 7:
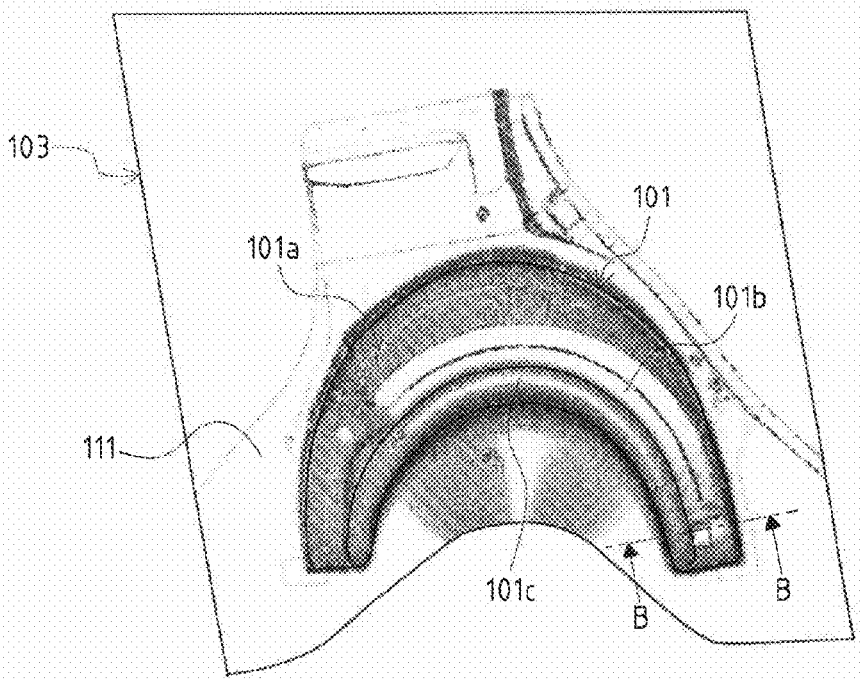
FIG. 7 is a plan view illustrating the press molding apparatus of the first conventional embodiment apart from the upper mold (the die face).

The effects obtained from above-explained press molding of the embodiment ("the present embodiment") are explained in comparison with a structure conventionally used for press molding the wheel house outer ("conventional embodiment") adding the reference of FIGS. 6 to 12. FIG. 6 is the B-B line sectional view of FIG. 7. The upper mold, not shown in FIG. 7, is depicted in FIG. 6.

As shown in FIGS. 6, 7, in the first conventional embodiment, a punch 101 is surrounded by a cushion 103 clamping a blank 150 with an upper mold 102. The cushion 103 has a lower clamping face 111 and the upper mold 102 has an upper clamping face 121, both of which are used for clamping the blank 150. These clamping faces 111, 121 are configured as level faces perpendicular to the moving direction of the upper mold 102, or flat faces with respect to the vertical direction.

When press molding the blank 150, the upper mold 102 and the cushion 103 clamp the blank 150 (see FIG. 6(*a*)). The plate blank 150 is held by the clamping faces 111, 121 ("blank-held state"). This blank-held state corresponds to the "held state" of the present embodiment. Proceeded from the blank-held state, the upper mold 102 moves downward with clamping the blank 150 in cooperated with the cushion 103, and the punch 101 acts on the blank 150, thereby performing the draw forming on the blank 150 (see FIG. 6(*b*)). The upper mold 102 moves downward and reaches the bottom dead end with the cushion 103, whereby the press molding of the blank 150 is finished (see FIG. 6(*c*)).

The punch 101 has a lower molding surface 101*a* provided with a protrusion 101*b* forming the highest portion in the product part (see the arrowed area E1 in FIG. 6(*c*)) of the surface 101*a*.

In such case that the surface 101*a* has the protrusion 101*b*, in drawing the blank 150, the blank 150 flows with contacting to the protrusion 101*b*, so that the cracks occur in the early stage of the press molding.

In the first conventional embodiment, the surface 101*a* has an additional protrusion 101*c* formed in the portion apart from the product part thereof. The additional protrusion 101*c* projects above the protrusion 101*b*. As shown in FIG. 7, the additional protrusion 101*c* is formed in the whole area of the inside of the punch 101 having the arc shape in plan view.

Thus, the punch 101 has the additional protrusion 101*c*, so that when the punch 101 contacts to the blank 150 in the blank-held state, the additional protrusion 101*c* contacts before the protrusion 101*b*. In the first conventional embodiment, due to the additional protrusion 101*c*, when the punch 101 contacts to the blank 150 in the blank-held state, the blank 150 is pressed and lifted by the additional protrusion 101*c* before the protrusion 101*b*, thereby delaying the contact of the protrusion 101*b* (in detail, the ridge of the protrusion 101*b*) to the blank 150 (see FIG. 6(*b*)). Therefore, in drawing the blank 150, preventing the blank 150 from flowing with contacting the protrusion 101*b*, the cracks is prevented from occurring in the early stage of the press molding.

In the first conventional embodiment, the height of the additional protrusion 101*c* is set as follows. As shown in FIG. 6(*b*), it is set as the height that the degree (31 of part of the blank 150 with respect to the clamping faces (level face), in which the protrusion 101*b* is included bordered by the additional protrusion 101*c*, becomes around 15 degrees when the protrusion 101*b* contacts the blank 150.

In the first conventional embodiment in which the additional protrusion 101*c* is formed in the punch 101, provided is reduction of the flow of the blank 150 with contacting the protrusion 101*b*, however, the additional protrusion 101*c* makes the depth of drawing deeper. Therefore, in the product part of the wheel house outer, the forming amount is increased in the portion where the blank 150 is difficult to flow, such as the corner portion, and the cracks occur easily.

More concretely, as to the first conventional embodiment, in the corner portion of the blank 150 when the upper mold 102 reaches the bottom dead end, that is when the molding is finished, the thickness reduction rate (elongation rate) of the blank 150 becomes 50% in maximum according to the simulation results. In the first conventional embodiment, the thickness reduction rate (elongation rate) of the blank 150 should be lower than 20%, provided that no cracks occur in the blank 150 after the molding.

Compared with the first conventional embodiment, the present embodiment provides the effects as follows.

In the present embodiment, the blank 50 is introduced between the first clamping and the second clamping, so that the punch 1 does not need the additional protrusion 101*c* as described in the first conventional embodiment, and the introduction of the blank 50 is finished before the start of molding for the blank 50 (before the lower molding surface 1*a* reaches the blank 50). There is no need to provide the additional protrusion 101*c* or the like in order to heighten the portion of the lower molding surface 1*a* apart from the product part, and it is possible to delay the contact timing of the lower molding surface 1*a* (protrusion of the punch) to the blank 50.

In detail, as shown in FIG. 3, the blank 50 is set horizontally in the first holding state (see FIG. 3(*a*)), and is deformed by the introduction performed before the held state (see FIG. 3(*b*)). Due to the introduction of the blank 50, in press molding of the blank 50, the contact timing of the protrusion 1*b* of the lower molding surface 1*a* is delayed.

Thus, in the present embodiment, the blank 50 flows without contact to the protrusion 1*b* of the lower molding surface 1*a*, applied no additional tension to the blank 50, thereby preventing the cracks in early stage of the molding. Moreover, the depth of drawing is shallower compared with the first conventional embodiment, thereby reducing the forming amount. As to the depth of drawing, it is reduced in the side portion provided with the additional protrusion 101*c*, that is the inside of the arc portion as the shape of the punch in plan view (hereinafter called "inside").

Figure 8:
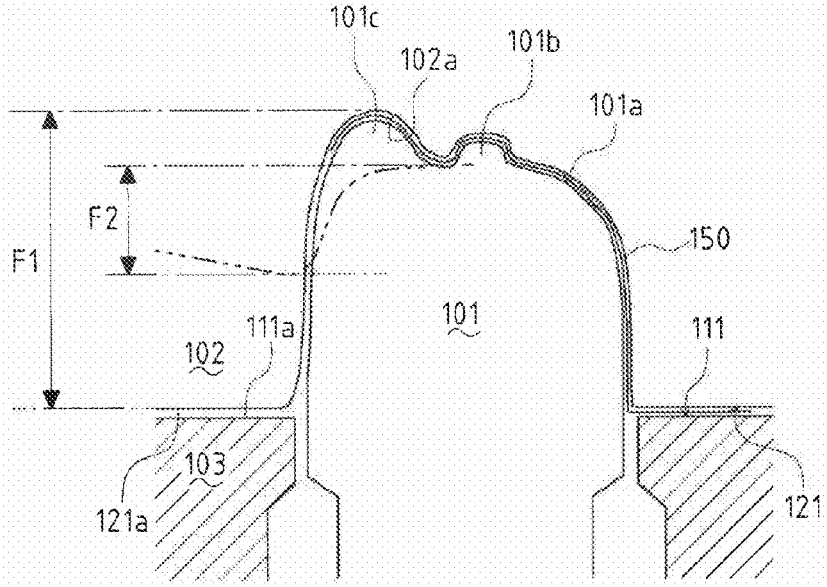
FIG. 8 is a schematic view illustrating the comparison of the depth of drawing between the first conventional embodiment and the present embodiment.

Concretely, as shown in FIG. 8, compared with the depth of drawing F1 of the first conventional embodiment, the depth of drawing F2 of the present embodiment depicted by two-dotted line is shallower.

The depth of drawing F1 of the first conventional embodiment is the distance between the upper clamping face 121 configured as level face and the deepest position (corresponding to the additional protrusion 101*c*) of an upper molding surface 102*a* of the upper mold 102. On the other hand, the depth of drawing F2 of the present embodiment is shallower than that of the first conventional embodiment, because the punch 1 does not have the additional protrusion 101*c* and the second upper clamping face 22 is positioned higher than the first upper clamping face 21 (which corresponds to the upper clamping face 121 of the first conventional embodiment).

As a result, in the present embodiment, less forming amount is obtained for drawing the blank 50 and the thickness reduction rate (elongation rate) of the blank 50 is reduced, which is advantageous in the cracks occurred in the blank 50.

Furthermore, in the present embodiment, the introduction of the blank 50 is performed before the molding is finished, so that the frictional heat caused by the flow of the blank 50 against the mold (molding face) on the molding process is reduced. Thus, reducing the frictional heat of the blank 50 generated by the press molding, the molding stability is improved.

Moreover, in the first conventional embodiment, the clamping faces facing each other are configured as the level faces (flat faces), and it is necessary to adjust the gap between the clamping faces (adjust the face gap according to the thickness of the blank 150), regarding the inside portion into which the blank 150 is flowed.

In the first conventional embodiment, the flow of the blank 150, which is occurred in drawing with clamping the blank 150, is occurred not from the outside of the arc portion as the shape of the punch 101 in plan view (hereinafter called "outside") but from the inside (see FIG. 6(*c*)). So, in the lower clamping face 111 and the upper clamping face 121, the portions (see the numerals 111*a*, 121*a* in FIG. 8) of the inside (left side in FIG. 6) forming the common surface with the outside need to be adjusted in the face gap. It means that the gap between the inside portions 111*a*, 121*a* of the clamping faces 111, 122 should be adjusted to allow the blank 150 flow in when drawing the blank 150.

On the contrary, in the present embodiment, there is no need to adjust the gap (to adjust the face gap according to the thickness of the blank 50) between the clamping faces, or the second clamping faces 12, 22, in the flow side of the blank 50 in drawing the blank 50.

In the present embodiment, the blank 50 also flows from the side of the inner clamping part 32 in drawing the blank 50, however, the second lower clamping face 12 in the inner clamping part 32 is formed by the inner cushion 4, which is separated from the outer cushion 3 having the second upper clamping face 22 in the outer clamping part 31, so that the adjustment of the face gap in the clamping faces of the inner clamping part 32 becomes unnecessary.

Figure 9:
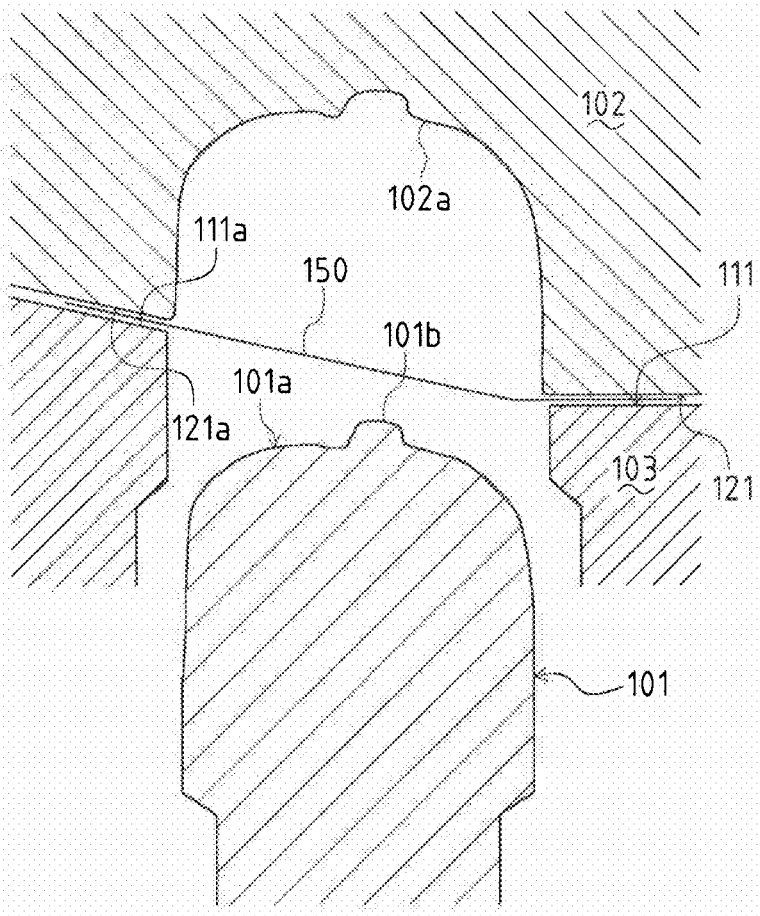
FIG. 9 is an enlarged section view illustrating the second conventional embodiment.

The second conventional embodiment is depicted in FIG. 9. In the following embodiments, using the same numerals to the same structures as the first conventional embodiment and they are not explained.

In the second conventional embodiment, in order to delay the contact timing of the lower molding surface 101*a* (the protrusion 101*b*) to the blank 150, the clamping face is partially lifted up.

As shown in FIG. 9, in the second conventional embodiment, the inside (left side in FIG. 9) portions (inside portions 111*a*, 121*a*) of the lower clamping face 111 and the upper clamping face 121 are lifted from the other portion (right side in FIG. 9), thereby inclining downwardly toward the punch 101.

Thus, in the second conventional embodiment, in which the clamping face is partially lifted up, the contact timing of the lower molding surface 101*a* to the blank 150, however, the wrinkles may occur in the blank 150 in the held state. Due to the shape lifted partially in the clamping face, when the blank 150 is clamped, the deformation such as bending is applied to the blank 150, so that the wrinkles occur in the clamped state (held state).

Such wrinkles occurred in the blank 150 in the held state ("blank wrinkles") prevent the blank 150 from flowing, thereby preventing the press molding performed on the blank 150.

On the contrary, in the present embodiment, the plate blank 50 is set horizontally and clamped, or the first clamping. When clamping the blank 50, the clamping faces of the outer clamping part 31 clamp the blank 50 set horizontally. Therefore, in the held state (first holding state), the blank wrinkles occurred in the second conventional embodiment are prevented from occurring.

To prevent the blank wrinkles of the blank 150 occurred in the second conventional embodiment, the lower clamping face 111 on which the blank 150 is set may have the flat inside portion 111*a*. The third conventional embodiment having such structure is depicted in FIG. 10.

Figure 10:
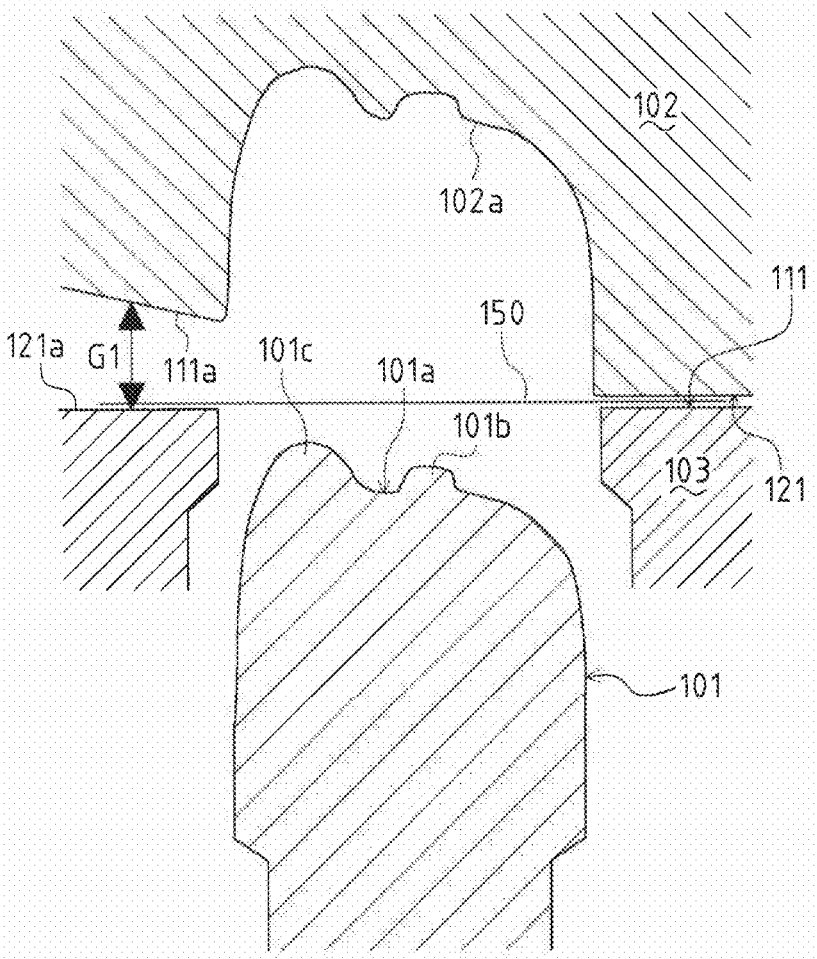
FIG. 10 is an enlarged section view illustrating the third conventional embodiment.

As shown in FIG. 10, the third conventional embodiment has the inside portion 121*a* of the upper clamping face 121 lifted and the inside portion 111*a* of the lower clamping face 111 formed as the level face (flat face) as same as the first conventional embodiment. In the third conventional embodiment, the inside portion 121*a* of the upper clamping face 121 is inclined downwardly toward the punch 101. The third conventional embodiment also has the additional protrusion 101*c* formed in the punch 101 to delay the contact timing of the protrusion 101*b* to the blank 150.

Thus, in the blank-held state of the third conventional embodiment, there exists a space between the clamping faces 111, 121. As shown in FIG. 10, in the blank-held state, the inside portions 111*a*, 121*a* of the clamping faces 111, 121 are separated from each other (see the arrowed area G1). Therefore, the inside portion of the blank 150 is not clamped by the upper mold 102 and the cushion 103.

In the above-described third conventional embodiment, the draw forming is performed without clamping the inside portion of the blank 150. Thus, during the molding of the blank 150, the unclamped portion is freely movable, so that the wrinkles such as waving may occur. Such wrinkles occurred in drawing of the blank 150 may become flow resistance of the blank 150 caused by the forming direction of the wrinkles, thereby preventing the press molding of the blank 150. As a result, in the third conventional embodiment, the variation in the flow amount of the blank 150 occurs, and the molding stability is not obtained.

On the contrary, in the present embodiment, the inside portion of the blank 50 is clamped by the inner clamping part 32, so that the blank 50 is not movable during molding. Thus, the wrinkles in the blank 50 are not formed during molding, and there does not occur the variation in the flow amount of the blank 50, so that the molding stability is improved.

Furthermore, in the present embodiment, the clamping load of the inner clamping part 32, that is the cushion load applied to the inner cushion 4 is adjusted to control the flow of the blank 50 from the inside of the blank 50. In this respect, the third conventional embodiment, forming the space between the inside portion, does not clamp the blank 150 in the inside portion, so that it is impossible to control the flow of the blank 150.

The present embodiment clamps the blank 50 using the outer clamping part 31, thereby preventing the blank wrinkles occurred in the first holding state. In addition, the inside portion of the blank 50 is clamped by the inner clamping part 32, thereby preventing the wrinkling of the blank 50 in the molding for the blank 50 from the held state. As a result, the molding stability is improved.

Figure 11:
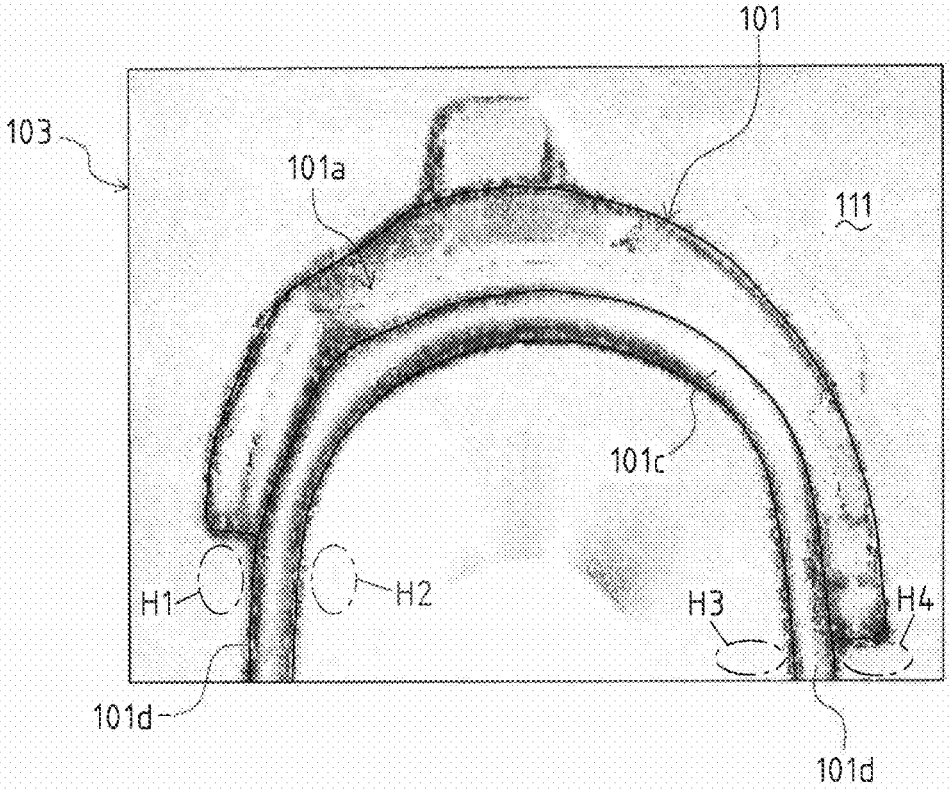
FIG. 11 is a plan view illustrating the press molding apparatus of the fourth conventional embodiment apart from the upper mold (the die face).

FIG. 11 depicts the fourth conventional embodiment. The fourth conventional embodiment adopts the open drawing for drawing the blank 150.

Concretely, as shown in FIG. 11, the additional protrusion 101*c*, as the punch 101 in the first embodiment, has extended portions 101*d* at the both ends thereof. In other words, the punch 101 has the additional protrusion 101*c*, formed in the whole area of the inside portion of the arc shape that is the plan view of the punch 101, extended over the blank 150. In draw forming, the additional portion of the blank 150, which is located around the extended portion 101*d* of the additional protrusion 101*c*, is clamped. The portions directed by the numerals H1 to H4 correspond to the clamped portion of the blank 150 clamped by the lower clamping face 111. Thus, in the open drawing, the portion except in the clamped portion in the blank 150 is not clamped and left open in drawing.

As to the additional protrusion 101*c*, the portion corresponding to the opened portion in the blank 150 (hereinafter called "protrusion opened portion") is positioned higher than the extended portion 101*d* corresponding to the clamped portion in the blank 150 due to the shape of the molded article or the like. Thus, in the additional protrusion 101*c*, the midterm portion (opened portion) is higher than the end portions.

Such open drawing aims to stabilize the flow of the blank 150 for controlling the flow balance, by extending the additional protrusion 101*c* over the blank 150 and by clamping the blank 150 around the extended portion 101*d*.

Unfortunately, the fourth conventional embodiment has the problems as follows.

When the punch 101 contacts to the blank 150, the protrusion opened portion contacts to the blank 150, in which the contacted portion the blank 150 is not clamped yet. Therefore, in draw forming, the blank 150 flows at the unclamped portion, thereby forming the wrinkles in the blank 150 caused by twisting. The protrusion opened portion is the highest portion in the punch 101, so that the first-contact portion to the blank 150 in the punch 101 is the protrusion opened portion. As a result, in draw forming, the blank 150 flows from the unclamped portion. The flow of the blank 150 in the protrusion opened portion causes the twisting and wrinkles. Further, the punch 101 has the additional protrusion 101*c*, whereby the forming amount becomes large and the cracks in the blank 150 easily occur.

Figure 12:
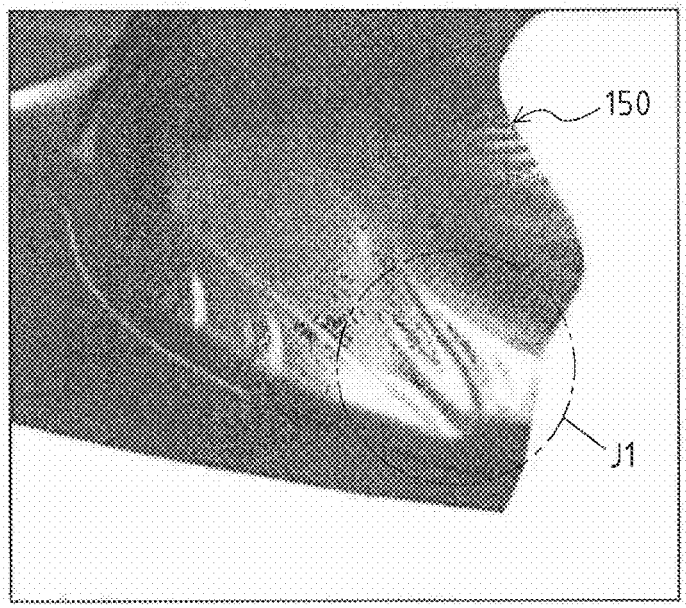
FIG. 12 is a picture showing the simulation result as to the blank during molding.

FIG. 12 depicts the simulation result for the wrinkles occurred in molding the blank 150 by means of the open drawing. As shown in FIG. 12, in the open drawing, the blank 150 flows from the unclamped portion, thereby occurring the wrinkle caused by twisting, e.g. the portion directed by the numeral J1. Such the wrinkle occurred in the blank 150 during the molding is left after the molding, which causes the defective product in the molded article.

Furthermore, in the fourth conventional embodiment, the blank 150 is clamped in the both ends of the additional protrusion 101*c*, that is the proximity of the extended portion 101*d*, so that the necessary clamped portion becomes large. In other words, the clamped portion in the blank 150 is needed at the proximity of the extended portion 101*d* where is beyond the product part, so that it needs the extra portion. Therefore, the blank 150 becomes large, which causes low yield.

In the fourth conventional embodiment, the additional protrusion 101*c* has the extended portion 101*d*, and in the low curvature portion such as the corner portion, the flow of the blank 150 is prevented, whereby the molding becomes hard. Therefore, in the fourth conventional embodiment, in order to facilitate the molding, the final shape of the molded article is modified, for example by enlarging the curvature, and the forming process is added to form the molded article into the final shape. In the fourth conventional embodiment, in press molding the blank 150, two-step forming is performed.

In contrast to the fourth conventional embodiment, the present embodiment provides that the blank 50 is clamped in the whole periphery by the outer and inner clamping parts 31, 32 in draw forming. Thus, the blank 50 does not have the opened portion, thereby the blank 50 prevented from occurring the wrinkles caused by twisting.

Moreover, in the present embodiment, the punch 1 does not have the additional protrusion 101*c* and the extended portion 101*d* extended from thereof, and the open drawing is not performed, so that the problems such as the low yield or additional process are solved.

It is obvious from the above-explained comparison with conventional embodiments, in the present embodiment, if the molded article has the complex curved shape and the forming amount is not even in draw forming, it is advantageous for the cracks and wrinkles of the blank, and the stability of molding is obtained.

The present embodiment is easily adoptable to the press molding such as the wheel house outer in which the clamped portion is used for the product part as the flange or the like.

INDUSTRIAL APPLICABILITY

The press molding method and press mold is advantageous for the cracks and wrinkles of the blank and can improve the molding stability even if the molded article has the complex curved shape and the forming amount (depth of drawing) is not even in draw forming.

The invention claimed is:

1. A press molding method of draw forming a plate material into a predetermined shape, clamping the material from both sides thereof using clamping faces facing, approaching and separating from each other, the method comprising:

first clamping the material at a portion where a depth of drawing to the predetermined shape is a first depth in the clamped portion of the material;

second clamping the material at a portion where the depth of drawing is a second depth in the clamped portion of the material, the first depth being deeper than the second depth; and between the first clamping and the second clamping, deforming the material such that the portion clamped in the second clamping is positioned in the drawing direction side with respect to the portion clamped in the first clamping, wherein the clamping faces used in the second clamping are inclined going from an inside edge to an outside edge toward the drawing direction, in accordance with a deformation angle of the material after the deforming, wherein a cushion load applied to the material by the second clamping is set so as to allow a material flow down the inclined clamping faces to the portion where the draw forming is performed to the second depth in draw forming and to prevent wrinkles caused by the deformation of the material, and wherein a cushion load applied to the material by the first clamping is set so as to not allow a material flow to the portion where the draw forming is performed to the second depth in draw forming.

2. The press molding method according to claim 1, wherein the deforming applied to the material is performed by moving the clamping faces used in the second clamping toward each other.

3. The press molding method according to claim 1, wherein the portion of the material that is clamped in the second clamping flows completely down the inclined clamping faces.

4. A press molding apparatus for draw forming a plate material into a predetermined shape, clamping the material from both sides thereof using clamping faces facing, approaching and separating from each other, the apparatus comprising:

a first clamping part that clamps the material at a portion where a depth of drawing to the predetermined shape is a first depth in the clamped portion of the material; and a second clamping part that clamps the material at a portion where the depth of drawing is a second depth in the clamped portion of the material, the first depth being deeper than the second depth, wherein the first clamping part clamps the material, followed by clamping the material by the second clamping part, wherein the clamping faces of the second clamping part approach each other to deform the material such that the portion clamped in the second clamping is positioned in the drawing direction side with respect to the portion clamped in the first clamping, wherein the clamping faces of the second clamping part are inclined going from an inside edge to an outside edge toward the drawing direction, in accordance with a deformation angle of the material after the material is deformed, wherein a cushion load applied to the material by the second clamping part is set so as to allow a material flow down the inclined clamping faces to the portion where the draw forming is performed to the second depth in draw forming and to prevent wrinkles caused by the deformation of the material, and wherein a cushion load applied to the material by the first clamping part is set so as to not allow a material flow to the portion where the draw forming is performed to the second depth in draw forming.

5. The press molding apparatus according to claim 4, wherein the portion of the material that is clamped by the second clamping part flows completely down the inclined clamping faces.

6. A press molding apparatus for draw forming a plate material into a predetermined shape, clamping the material from both sides thereof using clamping faces facing, approaching and separating from each other, the apparatus comprising:

a fixed mold;

a movable mold arranged to face the fixed mold, being movable in directions approaching and separating from the fixed mold; and first and second cushions arranged around the fixed mold, being movable in the approaching and separating directions, configured as molds that clamp the material in cooperation with the movable mold;

wherein the movable mold includes, as the clamping faces, a first clamping face that clamps in cooperation with the first cushion and a second clamping face that clamps in cooperation with the second cushion arranged in the drawing direction side, wherein the movable mold approaches the fixed mold, so that the movable mold and the first cushion clamp the material in a first clamping before the movable mold and the second cushion clamp the material in a second clamping, wherein in the first clamping, the movable mold and the first cushion clamp the material at a portion where a depth of drawing to the predetermined shape is a first depth in the clamped portion of the material, wherein in the second clamping, the movable mold and the second cushion clamp the material at a portion where a depth of drawing to the predetermined shape is a second depth in the clamped portion of the material, the first depth being deeper than the second depth, wherein between the first clamping and the second clamping, the material is deformed such that the portion clamped in the second clamping is positioned in the drawing direction side with respect to the portion clamped in the first clamping, wherein the second clamping face and the second cushion are inclined going from an inside edge to an outside edge toward the drawing direction, in accordance with a deformation angle of the material after the material is deformed, wherein a cushion load applied to the material by the second clamping is set so as to allow a material flow down the inclined second clamping face and the inclined second cushion to the portion where the draw forming is performed to the second depth in draw forming and to prevent wrinkles caused by the deformation of the material, and wherein a cushion load applied to the material by the first clamping is set so as to not allow a material flow to the portion where the draw forming is performed to the second depth in draw forming.

7. The press molding apparatus according to claim 6, wherein the portion of the material that is clamped by the second clamping face and the second cushion flows completely down the inclined second clamping face and the inclined second cushion.

* * * * *